US010388435B2

(12) United States Patent
Wachtel et al.

(10) Patent No.: US 10,388,435 B2
(45) Date of Patent: Aug. 20, 2019

(54) COMMUNICATIONS CABLE WITH IMPROVED ELECTRO-MAGNETIC PERFORMANCE

(71) Applicant: Panduit Corp., Tinley Park, IL (US)

(72) Inventors: Paul W. Wachtel, Arlington Heights, IL (US); Masud Bolouri-Saransar, Orland Park, IL (US); Ronald A. Nordin, Naperville, IL (US); Royal O. Jenner, Frankfort, IL (US); Gary E. Frigo, New Lenox, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 16/013,012

(22) Filed: Jun. 20, 2018

(65) Prior Publication Data

US 2018/0374609 A1 Dec. 27, 2018

Related U.S. Application Data

(60) Provisional application No. 62/524,669, filed on Jun. 26, 2017.

(51) Int. Cl.

| | |
|---|---|
| ***H01B 7/00*** | (2006.01) |
| ***H01B 11/08*** | (2006.01) |
| ***H01B 13/00*** | (2006.01) |
| ***H01B 13/26*** | (2006.01) |

(Continued)

(52) U.S. Cl.

CPC ..... *H01B 11/08* (2013.01); *H01B 7/02* (2013.01); *H01B 11/1008* (2013.01); *H01B 13/0036* (2013.01); *H01B 13/26* (2013.01); *H01B 11/1016* (2013.01)

(58) Field of Classification Search

USPC .... 174/102 R, 102 SC, 110 R, 113 R, 113 C, 174/115, 116

See application file for complete search history.

(56) References Cited

U.S. PATENT DOCUMENTS

| | | | |
|---|---|---|---|
| 3,312,774 | A | 4/1967 | Peterson |
| 3,903,354 | A | 9/1975 | Dageförde |
| 4,205,119 | A | 5/1980 | Young et al. |

(Continued)

FOREIGN PATENT DOCUMENTS

| | | |
|---|---|---|
| CA | 2413187 A1 | 1/2002 |
| EP | 1301930 B1 | 1/2007 |

(Continued)

*Primary Examiner* — William H. Mayo, III

(74) *Attorney, Agent, or Firm* — Christopher S. Clancy; James H. Williams; Christopher K. Marlow

(57) ABSTRACT

A communications cable has a cable core with a plurality of twisted pairs of conductors and a metal foil tape disposed between the cable core and a jacket of the communications cable. The metal foil tape has a plurality of cuts that create a plurality of discontinuous regions in a metal layer of the metal foil tape. The metal foil tape is wrapped around the cable core such that the discontinuous regions overlap to form a plurality of overlapping regions. The overlapping regions producing capacitances connected in series, reducing an overall capacitance between the overlapping discontinuous regions. The plurality of cuts form a Y-shape cut having a first straight cut starting at one side of the metal foil tape and two cuts branching off of the first straight cut at opposite angles near a second side of the metal foil tape.

4 Claims, 8 Drawing Sheets

(51) Int. Cl.
*H01B 7/02* (2006.01)
*H01B 11/10* (2006.01)

(56) References Cited

U.S. PATENT DOCUMENTS

| | | | | |
|---|---|---|---|---|
| 6,559,385 | B1 | 5/2003 | Johnson et al. | |
| RE42,266 | E | 4/2011 | Sparrowhawk | |
| 7,923,632 | B2 * | 4/2011 | Smith | H01B 11/1008 174/112 |
| 7,923,641 | B2 * | 4/2011 | Smith | H01B 11/1008 174/113 R |
| 8,119,906 | B1 | 2/2012 | Smith et al. | |
| 8,119,907 | B1 * | 2/2012 | McNutt | H01B 11/1008 174/36 |
| 8,183,462 | B2 | 5/2012 | Nordin et al. | |
| 8,217,267 | B2 | 7/2012 | Nordin et al. | |
| 8,354,590 | B2 * | 1/2013 | Nordin | B32B 7/12 174/110 R |
| 8,445,787 | B2 | 5/2013 | Nordin et al. | |
| 8,450,600 | B2 * | 5/2013 | Sharma | C03C 3/078 136/256 |
| 8,558,115 | B2 | 10/2013 | Jenner et al. | |
| 8,927,866 | B2 * | 1/2015 | Nordin | H01B 11/08 174/110 R |
| 8,987,591 | B2 * | 3/2015 | Nordin | H01B 11/1008 174/113 R |
| 9,012,778 | B2 | 4/2015 | Nordin et al. | |
| 9,024,193 | B2 | 5/2015 | Nordin et al. | |
| 9,087,630 | B2 * | 7/2015 | Camp, II | H01B 11/06 |
| 9,129,727 | B2 * | 9/2015 | Caveney | H01B 11/1008 |
| 9,196,398 | B2 | 11/2015 | Kroushi et al. | |
| 9,214,260 | B2 * | 12/2015 | Ishikawa | H01B 7/30 |
| 2006/0048961 | A1 * | 3/2006 | Pfeiler | H01B 11/085 174/36 |
| 2007/0037419 | A1 * | 2/2007 | Sparrowhawk | H01B 11/1008 439/98 |
| 2009/0283288 | A1 | 11/2009 | Ben-Ary | |
| 2013/0248218 | A1 | 9/2013 | Glew et al. | |
| 2016/0042838 | A1 | 2/2016 | Glew et al. | |
| 2016/0042839 | A1 | 2/2016 | Glew et al. | |

FOREIGN PATENT DOCUMENTS

| | | | |
|---|---|---|---|
| JP | 2015038857 | A | 2/2015 |
| WO | 2006105166 | A2 | 10/2006 |
| WO | 2010129680 | A1 | 11/2010 |

* cited by examiner

39

40

41

45

46

COMMUNICATIONS CABLE WITH IMPROVED ELECTRO-MAGNETIC PERFORMANCE

CROSS REFERENCE TO RELATED APPLICATION

This application claims priority to U.S. Provisional Application No. 62/524,669, filed Jun. 26, 2017, the subject matter of which is hereby incorporated by reference in its entirety.

BACKGROUND OF THE INVENTION

As networks become more complex and have a need for higher bandwidth cabling, attenuation of cable-to-cable crosstalk (or "alien crosstalk") becomes increasingly important to provide a robust and reliable communications system. Alien crosstalk is primarily coupled electromagnetic noise that can occur in a disturbed cable arising from signal-carrying cables that run near the disturbed cable, and, is typically characterized as alien near end crosstalk (ANEXT), or alien far end crosstalk (AFEXT).

SUMMARY OF THE INVENTION

A communications cable having a plurality of twisted pairs of conductors and various embodiments of a metal foil tape between the twisted pairs and a cable jacket is disclosed. In some embodiments, the metal foil tapes include a cut that creates discontinuous regions in a metal layer of the metal foil tapes. When the metal foil tapes are wrapped around the cable core, the discontinuous regions overlap to form at least one overlapping region. The cuts are formed such that overlapping region is small and limits current flow through the metal foil tapes, thereby minimizing alien crosstalk in the communications cable.

DETAILED DESCRIPTION

Figure 1:
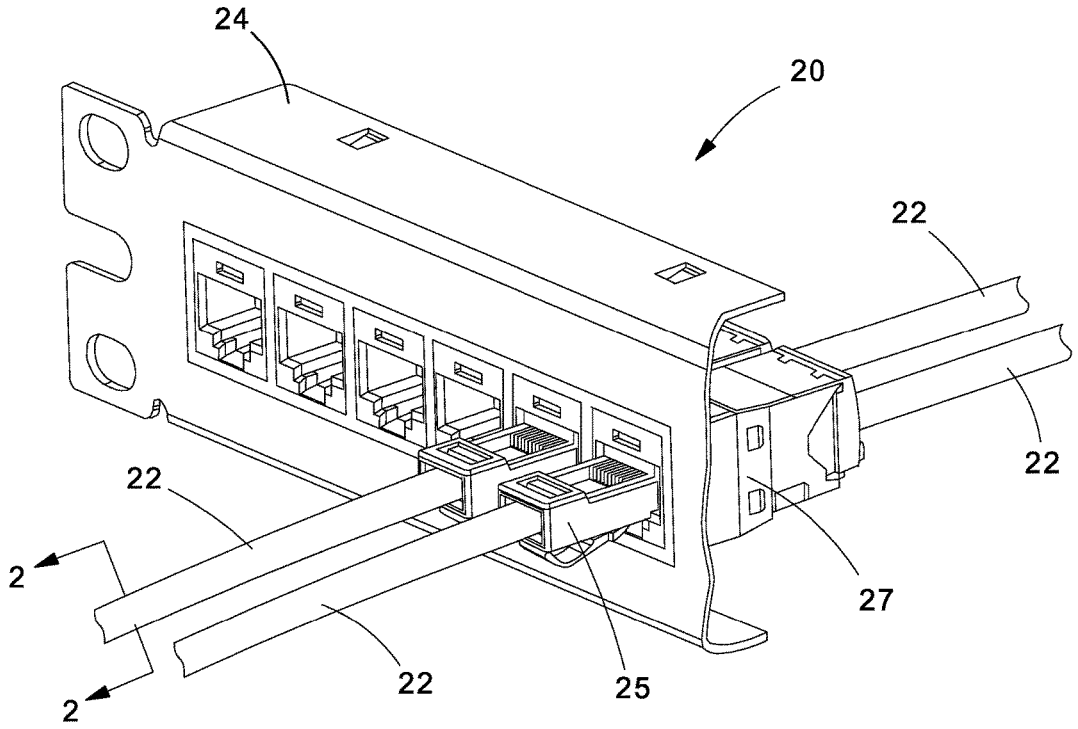
FIG. 1 is an illustration of a perspective view of a communications system.

To attenuate alien crosstalk, continuous or discontinuous metal foil tape may be wrapped around the inner core of the cable. Unterminated continuous metal foil tape cable systems can have unwanted electro-magnetic radiation and or susceptibility issues. A discontinuous metal foil tape cable system greatly reduces the electro-magnetic radiation and or susceptibility issues.

Examples disclosed herein describe communications cables that include various embodiments of discontinuous metal foil tapes positioned between the jacket and unshielded conductor pairs of the cables. Discontinuities may be created in the disclosed metal foil tapes to prevent current from creating standing waves in the wavelengths of interest in the metal foil tapes down the length of the cables. Without the discontinuities, the metal foil tapes would be equivalent to an unterminated shielded cable, and would therefore suffer from degraded EMC performance.

Reference will now be made to the accompanying drawings. Wherever possible, the same reference numbers are used in the drawings and the following description to refer to the same or similar parts. It is to be expressly understood, however, that the drawings are for the purpose of illustration and description only. While several examples are described in this document, modifications, adaptations, and other implementations are possible. Accordingly, the following detailed description does not limit the disclosed examples. Instead, the proper scope of the disclosed examples may be defined by the appended claims.

FIG. 1 is a perspective view of a communications system 20, which includes at least one communications cable 22, connected to equipment 24. Equipment 24 is illustrated as a patch panel in FIG. 1, but the equipment can be passive equipment or active equipment. Examples of passive equipment can be, but are not limited to, modular patch panels, punch-down patch panels, coupler patch panels, wall jacks, etc. Examples of active equipment can be, but are not limited to, Ethernet switches, routers, servers, physical layer management systems, and power-over-Ethernet equipment as can be found in data centers/telecommunications rooms; security devices (cameras and other sensors, etc.) and door access equipment; and telephones, computers, fax machines, printers and other peripherals as can be found in workstation areas. Communications system 20 can further include cabinets, racks, cable management and overhead routing systems, and other such equipment.

Communications cable 22 is shown in the form of an unshielded twisted pair (UTP) cable, and more particularly a Category 6A cable which can operate at 10 Gb/s, as is shown more particularly in FIG. 2, and which is described in more detail below. Communications cable 22 may, however, be a variety of other types of communications cables, as well as other types of cables. Cables 22 can be terminated directly into equipment 24, or alternatively, can be terminated in a variety of plugs 25 or jack modules 27 such as an RJ45 type, jack module cassettes, and many other connector types, or combinations thereof. Further, cables 22 can be processed into looms, or bundles, of cables, and additionally can be processed into pre-terminated looms.

Communication cable 22 can be used in a variety of structured cabling applications including patch cords, backbone cabling, and horizontal cabling, although the present invention is not limited to such applications. In general, the present invention can be used in military, industrial, telecommunications, computer, data communications, and other cabling applications.

Figure 2:
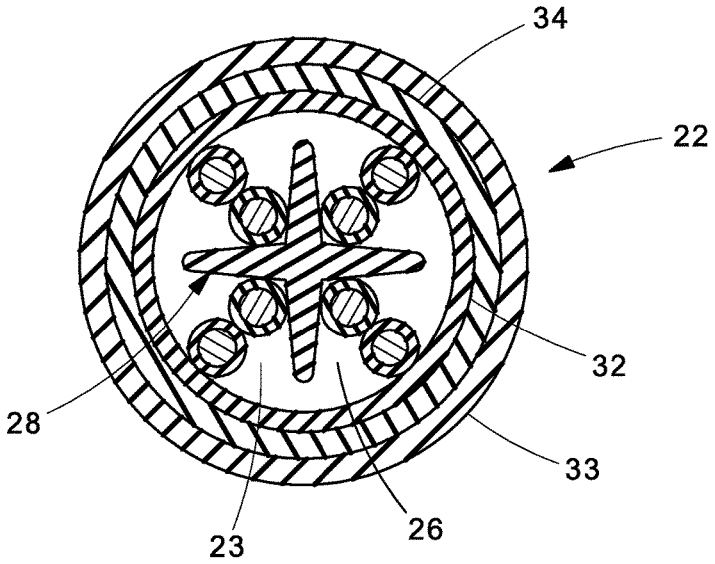
FIG. 2 is an illustration of a cross-sectional view of a communications cable.
Figure 3:
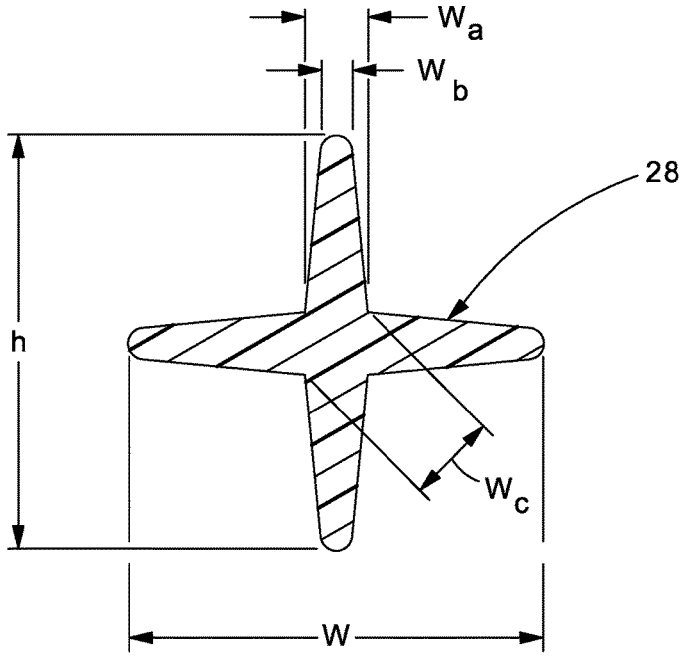
FIG. 3 is an illustration of a cross-sectional view of a pair separator.

Referring to FIG. 2, there is shown a transverse cross-section of cable 22, taken along section line 2-2 in FIG. 1. Cable 22 may include an inner core 23 with four twisted conductive wire pairs 26 that are separated with a pair separator 28. Cross-section of pair separator 28 is shown in more detail in FIG. 3. Pair separator 28 may be formed with a clockwise rotation (left hand lay) with a cable stranding or lay length. An example lay length may be 3.2 inches. Pair separator 28 can be made of a plastic, such as a solid fire retardant polyethylene (FRPE), for example.

A wrapping of barrier tape 32 may surround inner core 23. Barrier tape 32 can be helically wound or longitudinally wrapped around inner core 23. As shown in FIG. 2, the twisted pair conductors may extend beyond pair separator 28 to create an outer diameter of inner core 23. The outer diameter may be, for example, approximately 0.2164 inches, and the circumference may be 0.679 inches. In some implementations, barrier tape 32 may wrap around inner core 23 slightly more than twice, and there may be two applications of barrier tape 32.

Figure 4:
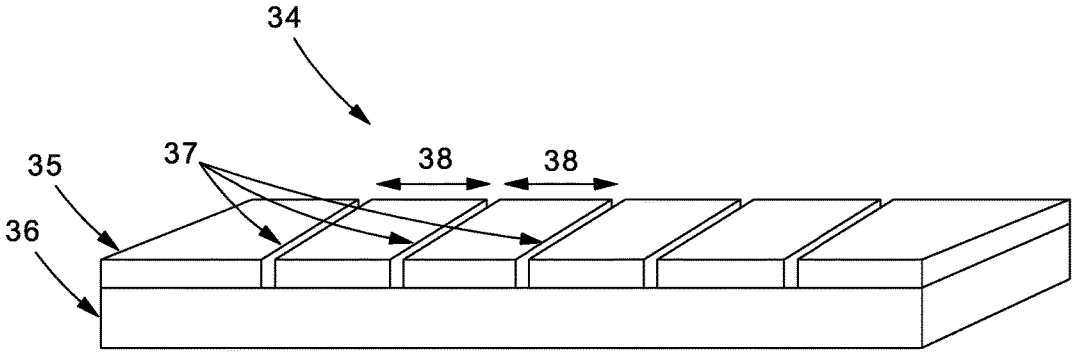
FIG. 4 is an illustration of a perspective view of a discontinuous metal foil tape.

Metal foil tape 34 may be longitudinally wrapped around barrier tape 32 under cable jacket 33 along the length of communications cable 22. That is, metal foil tape 34 may be wrapped along its length such that it wraps around the length of communications cable 22 in a "cigarette" style wrapping. As shown in FIG. 4, metal foil tape 34 may comprise a metal layer 35 (e.g., aluminum) adhered to a polymer film support layer 36. In some implementations, metal layer 35 may be adhered to polymer layer 36 with glue. Metal foil tape 34 may be a discontinuous metal foil tape, in that discontinuities 37 may be created in metal layer 35, for example, in a post-processing step where lasers are used to ablate portions of metal layer 35.

To maximize alien crosstalk benefits, metal foil tape 34 may be wrapped around the core such that it completely surrounds the circumference of conductive wire pairs 26 and barrier tape 32 such that the edges of metal layer 35 overlap when fully assembled into communications cable 22. Depending on the size of communications cable 22, the width of metal foil tape 34, the geometry of the laser ablated cut (i.e., discontinuities 37), and the precision of metal foil tape 37 application, the overlapping area can include a portion of two adjacent discontinuous segments 38 resulting in a significant capacitance between adjacent discontinuous segments 38. If the capacitance between neighboring segments 38 is too high, high frequency currents can flow virtually unimpeded from one segment 38 to the next through the overlapping region of metal foil tape 34 which negates the EMC benefits of the discontinuous segments 38.

To reduce the capacitance between neighboring segments 38, metal foil tape 34 may be designed to limit the overlapping region of metal foil tape 34 when wrapped around communications cable 22 such that the current flow through metal foil tape 34 is impeded for frequencies up to the usable bandwidth for Cat6A applications (e.g., 500 MHz). In some implementations, various geometries and configurations of discontinuities 37 may be used to limit the capacitance between neighboring segments 38 to approximately 4 pF or less.

FIGS. 5A-5H and 6A-5H illustrate various example geometries and configurations of discontinuities that may be created in metal foil tape 34. FIGS. 5A-5H illustrate metal foil tape 34 in a flat or unwrapped orientation prior to being applied to communications cable 22, and FIGS. 6A-6H illustrate metal foil tape 34 after being applied or wrapped around communications cable 22.

Figure 5A:
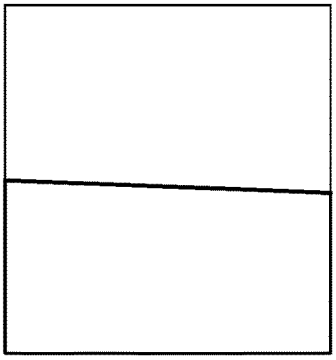
FIGS. 5A-5H and 6A-6H are illustrations of various example geometries and configurations of discontinuities that may be created in discontinuous metal foil tape.
Figure 6A:
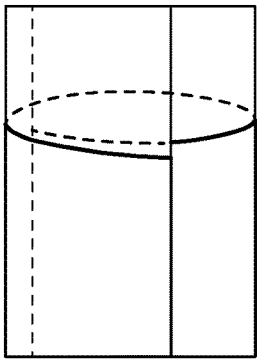

FIGS. 5A and 6A illustrate an example straight cut 39. Ideally, straight cut 39 would be orthogonal to the direction of communications cable 22 and the tape would be wrapped longitudinally such that the edges of straight cut 39 would overlap each other and there would be zero overlap capacitance between adjacent segments 38 of the metal foil tape 34. In practice, there are tolerances associated with the accuracy of the cut and the application of metal foil tape 34 during the jacketing process. These tolerances will result in an offset angle causing the edges of straight cut 39 to be misaligned when wrapped longitudinally around cable core 23. This misalignment produces an overlapping capacitance proportional to the offset angle and the width of metal foil tape 34 relative to the diameter of cable core 23. The overlapping region is rectangular in nature and is illustrated in FIG. 6A for a 1 degree offset angle.

Figure 5B:
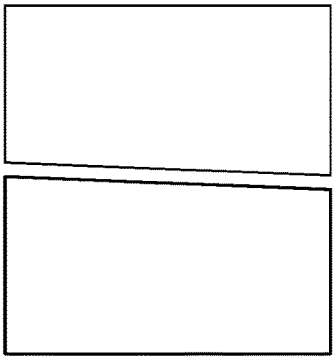
Figure 6B:
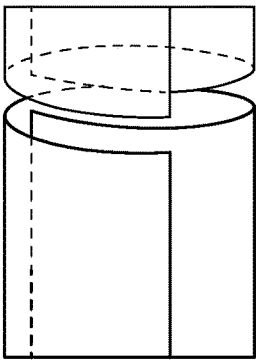

FIGS. 5B and 6B illustrate an example double cut 40. Double cut 40 introduces two parallel cuts that are ideally orthogonal to the direction of communications cable 22. Due to the same manufacturing tolerances described above for straight cut 39, an offset angle will be introduced and the edges of the two parallel cuts will be misaligned when wrapped longitudinally around cable core 23. The overlapping capacitance from this misalignment is proportional to the offset angle and the width of metal foil tape 34 relative to the diameter of cable core 23. By incorporating two laser cuts, an additional discontinuous segment 38 is introduced into metal foil tape 34 and two overlapping regions are created when metal foil tape 34 is wrapped around cable core 23. This produces two virtually identical overlapping capacitances connected in series which has the net effect of reducing the capacitance by a factor of two. The two overlapping regions are rectangular in nature and are illustrated in FIG. 6B for a 1 degree offset angle.

Figure 5C:
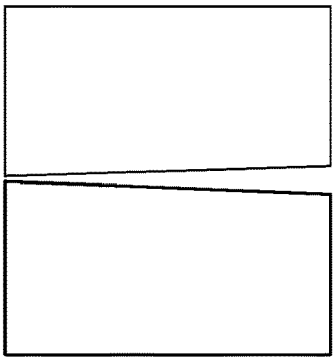
Figure 6C:
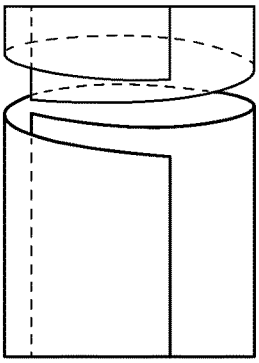

FIGS. 5C and 6C illustrate an example trapezoidal cut 41. Trapezoidal cut 41 introduces two cuts that traverse the width of metal foil tape 34 at opposite angles. The beginning of the two cuts are separated by a gap. At the end of the cuts, the gap is larger which gives the appearance of a trapezoid. The overlapping area of metal foil tape 34 will be in the shape of a parallelogram which is proportional to the starting gap of the two laser cuts and the angle of the laser cuts. By incorporating two laser cuts, an additional parallelogram shape will be created. These two overlapping parallelogram shapes create two capacitances connected in series which has the net effect or reducing the capacitance by a factor of two. Any manufacturing tolerances are accommodated by the trapezoidal nature of the cuts resulting in small variations in the areas of the two parallelograms. The two overlapping regions are illustrated in FIG. 6C for a 10 mil. gap at the beginning of the cuts and a cut angle of +2 and −2 degrees.

Figure 5D:
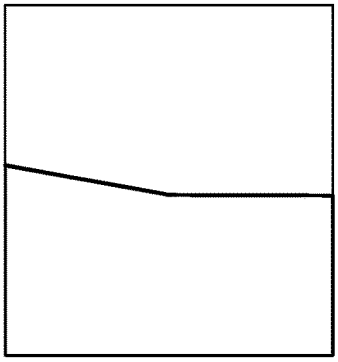
Figure 6D:
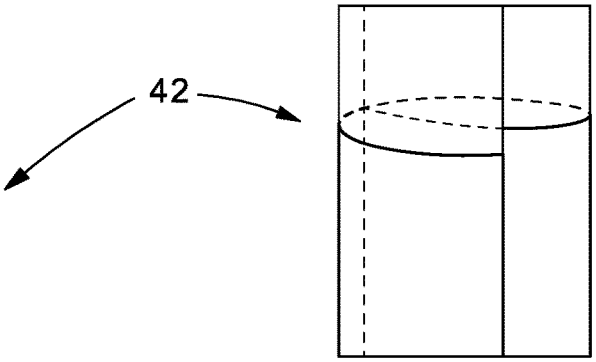

FIGS. 5D and 6D illustrate an example half-angle cut 42. Half-angle cut 42 introduces a single cut the starts as a straight cut which is orthogonal to the direction of communications cable 22 and transitions to an angled cut about half way across metal foil tape 34. When metal foil tape 34 is applied longitudinally, the overlapping area of metal foil tape 34 will be in the shape of a polygon which is proportional to the angle of the laser cut at the half way point. Any manufacturing tolerances are accommodated by this angled cut leading to small variation in the overlapping areas. The overlapping region illustrated in FIG. 6D may be, for example, for a 5-degree angle.

Figure 5E:
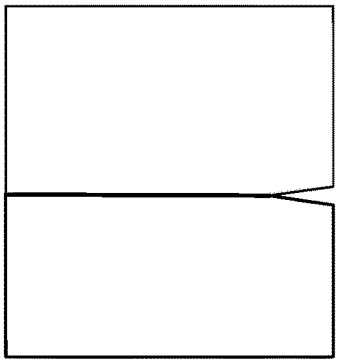
Figure 6E:
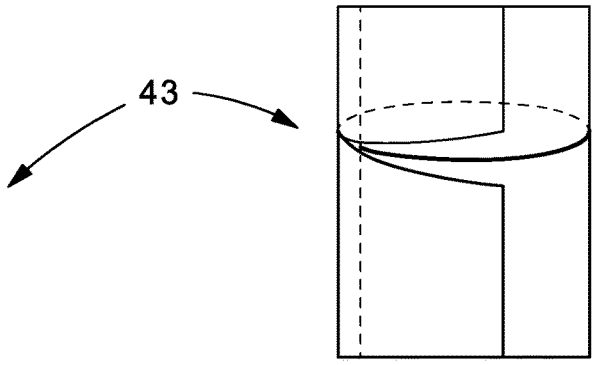

FIGS. 5E and 6E illustrate an example Y-shaped cut 43. Y-shaped cut 43 introduces a single cut that starts as a straight cut which is orthogonal to the direction of communications cable 22 and branches out at opposite angles at an appropriate location across metal foil tape 34. The result of the cut resembles a Y shape. When metal foil tape 34 is applied longitudinally, the overlapping areas of metal foil tape 34 will create triangular shapes along each branch of Y-shaped cut 43. The area of the overlapping triangular shapes will be proportional to the angle of the Y branches and the location where the laser cut branches out from the straight portion. These triangular overlapping shapes create two capacitances connected in series which has the net effect of reducing the capacitance by a factor of two. Any manufacturing tolerances are accommodated by the angle of the branching laser cuts leading to small variation in the overlapping areas. The overlapping regions illustrated in FIG. 6E may be, for example, for a 4-degree angle.

Figure 5F:
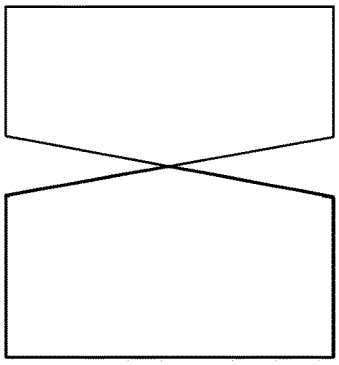
Figure 6F:
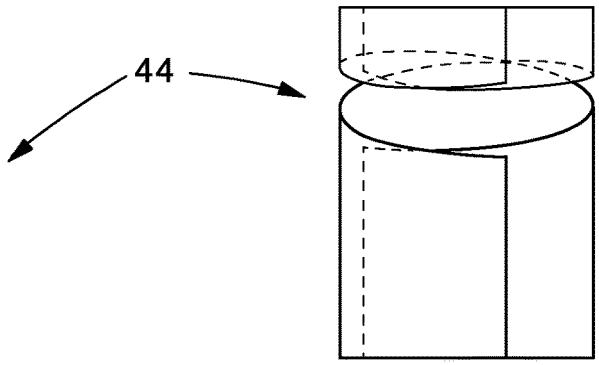

FIGS. 5F and 6F illustrate an example X-shaped cut 44. X-shaped cut 44 introduces two angled cuts that intersect at the center of metal foil tape 34. The result is an X-shaped pattern on metal foil tape 34. When metal foil tape 34 is applied longitudinally, the overlapping areas of metal foil tape 34 will create two pairs of triangular shapes proportional to the angle of the cuts for a total of four overlapping triangular areas. Each pair of triangles creates two capacitances connected in parallel which has the net of effect of doubling the capacitance of a single overlapping triangle. The net capacitance from one pair of triangular shapes is in series with the net capacitance from the second pair of triangular shapes which has the net effect of reducing the overall capacitance by a factor of two. Given the series and parallel arrangement of the four overlapping capacitances, the result of the overlapping metal foil tape 34 is proportional to the area of a single triangular shape. Any manufacturing tolerances are accommodated by the angle of the cuts leading to small variation in the overlapping areas. The overlapping regions illustrated in FIG. 6F may be, for example, for a 5-degree angle.

Figure 5G:
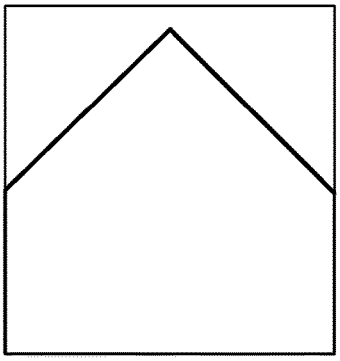
Figure 6G:
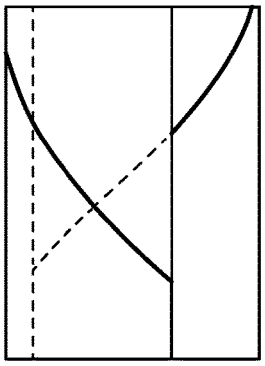

FIGS. 5G and 6G illustrate an example chevron cut 45. The chevron cut 45 introduces a single cut starting at a 45-degree angle and switches to a minus 45-degree angle near the center of metal foil tape 34. The result is an upside-down V-shaped cut pattern on metal foil tape 34. When metal foil tape 34 is applied longitudinally, the overlapping areas of the metal foil tape will create a pair of triangular shapes. The pair of triangles creates two capacitances connected in parallel which has the net of effect of doubling the capacitance of a single overlapping triangle. Any manufacturing tolerances are accommodated by the 45-degree angle of the cuts leading to small variation in the overlapping areas.

Figure 5H:
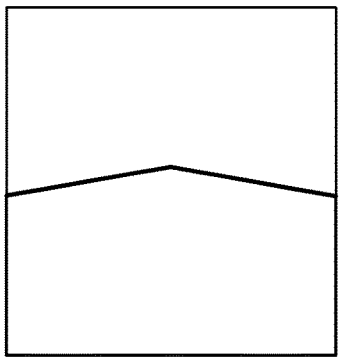
Figure 6H:
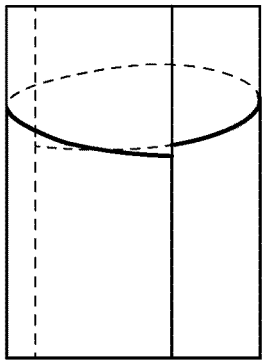

FIGS. 5H and 6H illustrate an example shallow chevron cut 46. Shallow chevron cut 46 may be a variation of chevron cut 45 illustrated in FIGS. 5G and 6G, whereby the angle is changed from 45-degrees to a shallower angle. The result is a broader V-shaped cut pattern on metal foil tape 34. When metal foil tape 34 is applied longitudinally, the overlapping areas of metal foil tape 34 will create a pair of triangular shapes. The overlapping area of the triangles is much smaller than for chevron cut 45 due to the shallow angles of the cut. The pair of triangles creates two capacitances connected in parallel which has the net of effect of doubling the capacitance of a single overlapping triangle. Any manufacturing tolerances are accommodated by the angle of the cuts leading to small variation in the overlapping areas. The overlapping regions illustrated in FIG. 6H may be, for example, for a 5-degree angle.

Figure 7:
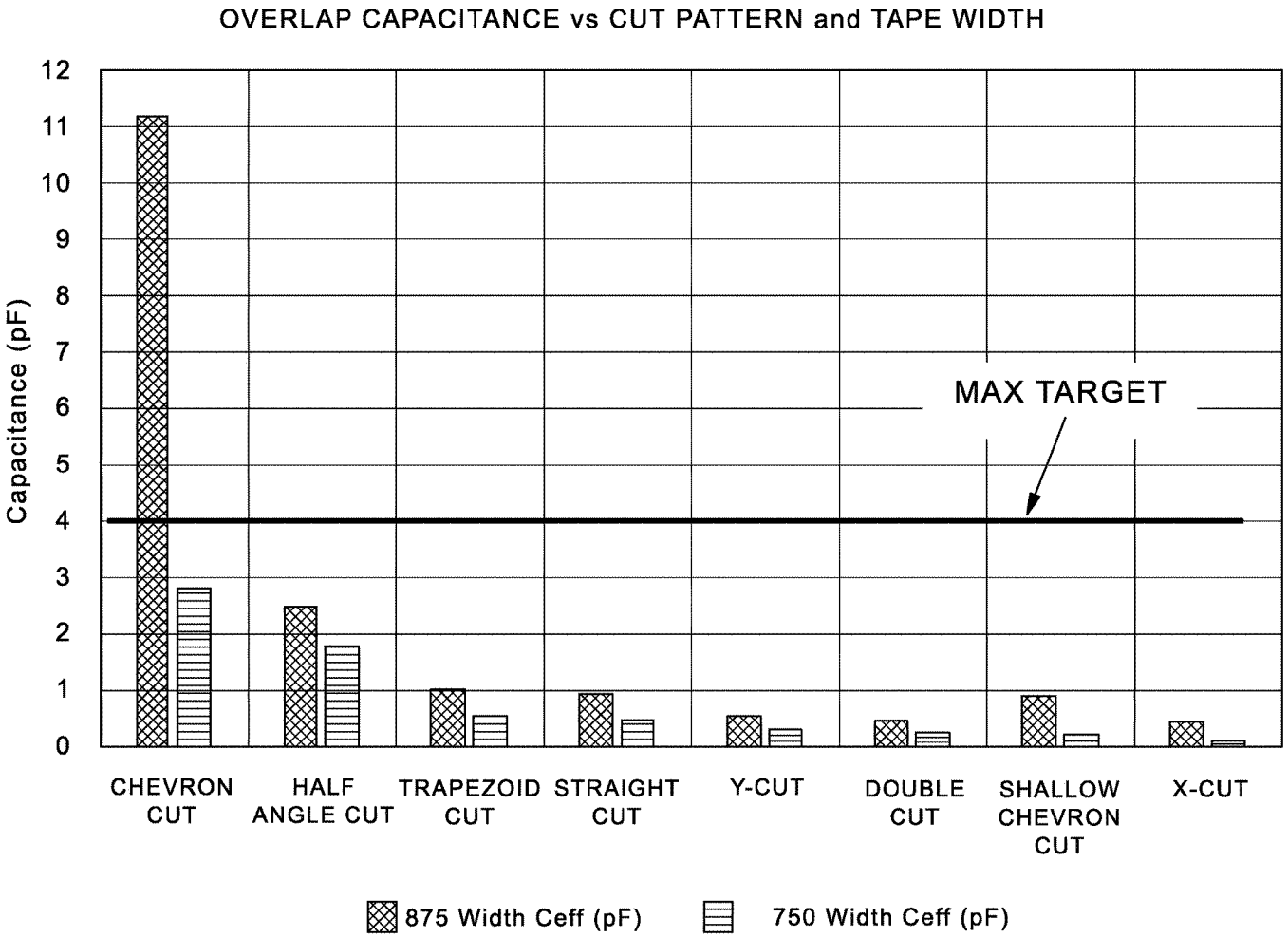
FIG. 7 is an illustration of overlap capacitances for the example geometries and configurations of discontinuous metal foil tape illustrated in FIGS. 5A-5H and 6A-6H.

For each of the different implementations of cuts illustrated in FIGS. 5A-5H and 6A-6H, a first order calculation of the resulting capacitance between neighboring discontinuous segments of the metal foil tape can be calculated, based on the area of the overlapping regions and the dielectric material between the overlapping metal layer of the metal foil tape. FIG. 7 illustrates the overlap capacitance for each style of laser cut. The capacitances illustrated in FIG. 7 for each cut may be calculated using example metal foil tape widths of 750 mils and 875 mils. The core diameter of the communications cable which the metal foil tape is enclosing may be, for example, 200 mils. The dielectric material may be, for example, a 2 mils Mylar material. The target overlap capacitance for this example may be less than 4 pF.

As shown in FIG. 7, several of the cut geometries satisfy the target objective of overlap capacitance less than 4 pF. The impact to manufacturing the metal foil tape for each of these cut geometries is also considered. The geometries that implement a single cut such as half angle cut 42, straight cut 39, and shallow chevron cut 46 allow for quick processing times because they use as few lasers as possible and are simple to implement in the laser cutting machine. Y-shaped cut 43 shows minimal sensitivity to the width of the metal foil tape.

Figure 8:
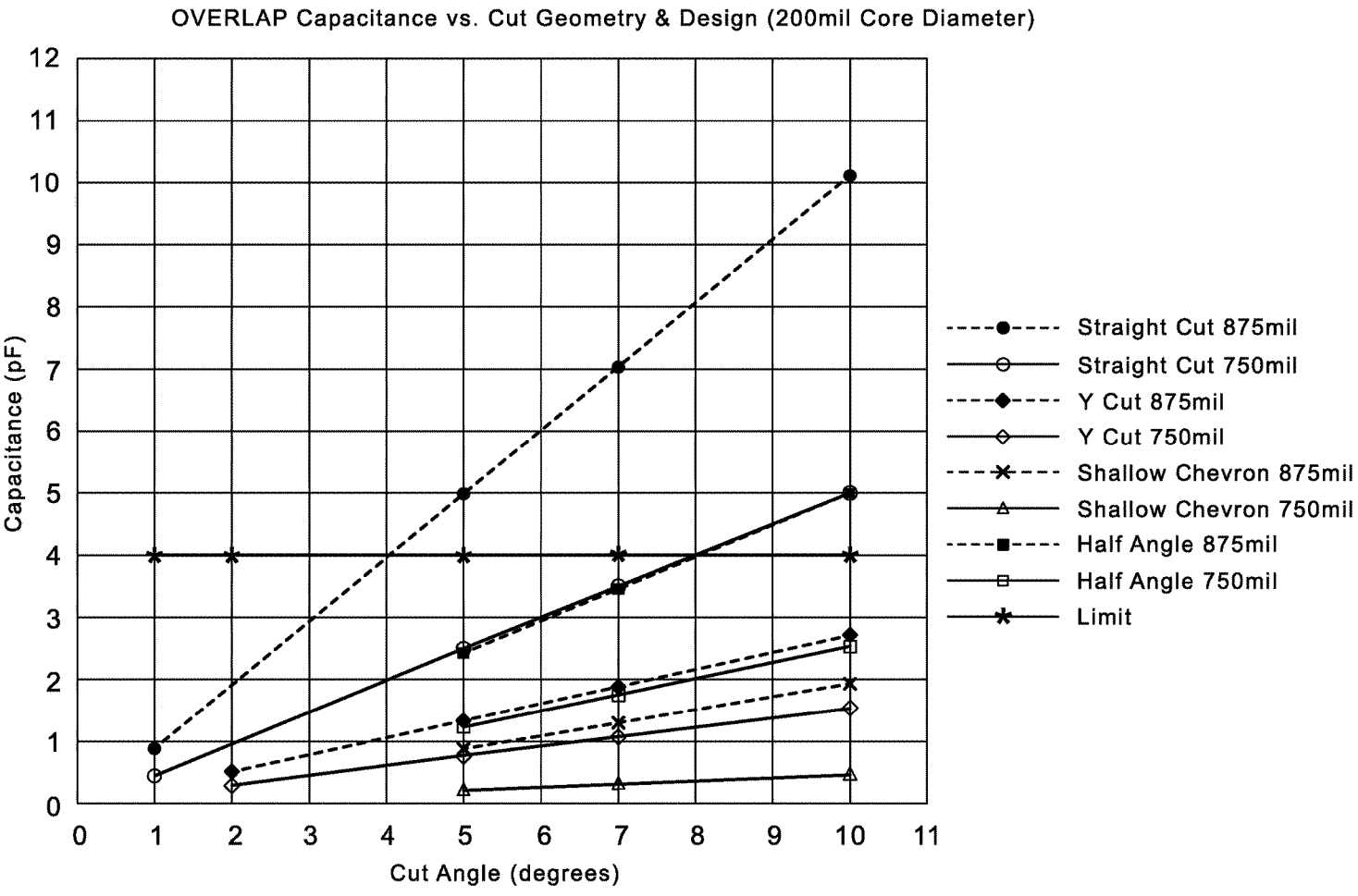
FIGS. 8 and 9 are illustrations of overlap capacitances for the example geometries and configurations of discontinuous metal foil tape illustrated in FIGS. 5A-5H and 6A-6H at different core diameters.

Tolerances associated with the laser process and metal foil tape application process can be modeled as changes in laser cut angles which will in turn alter the area of the overlapping metal foil tape geometries. FIG. 8 illustrates how sensitive the overlap capacitance is to a change in cut angle for a given cut geometry and a 200 mils cable core diameter.

Figure 9:
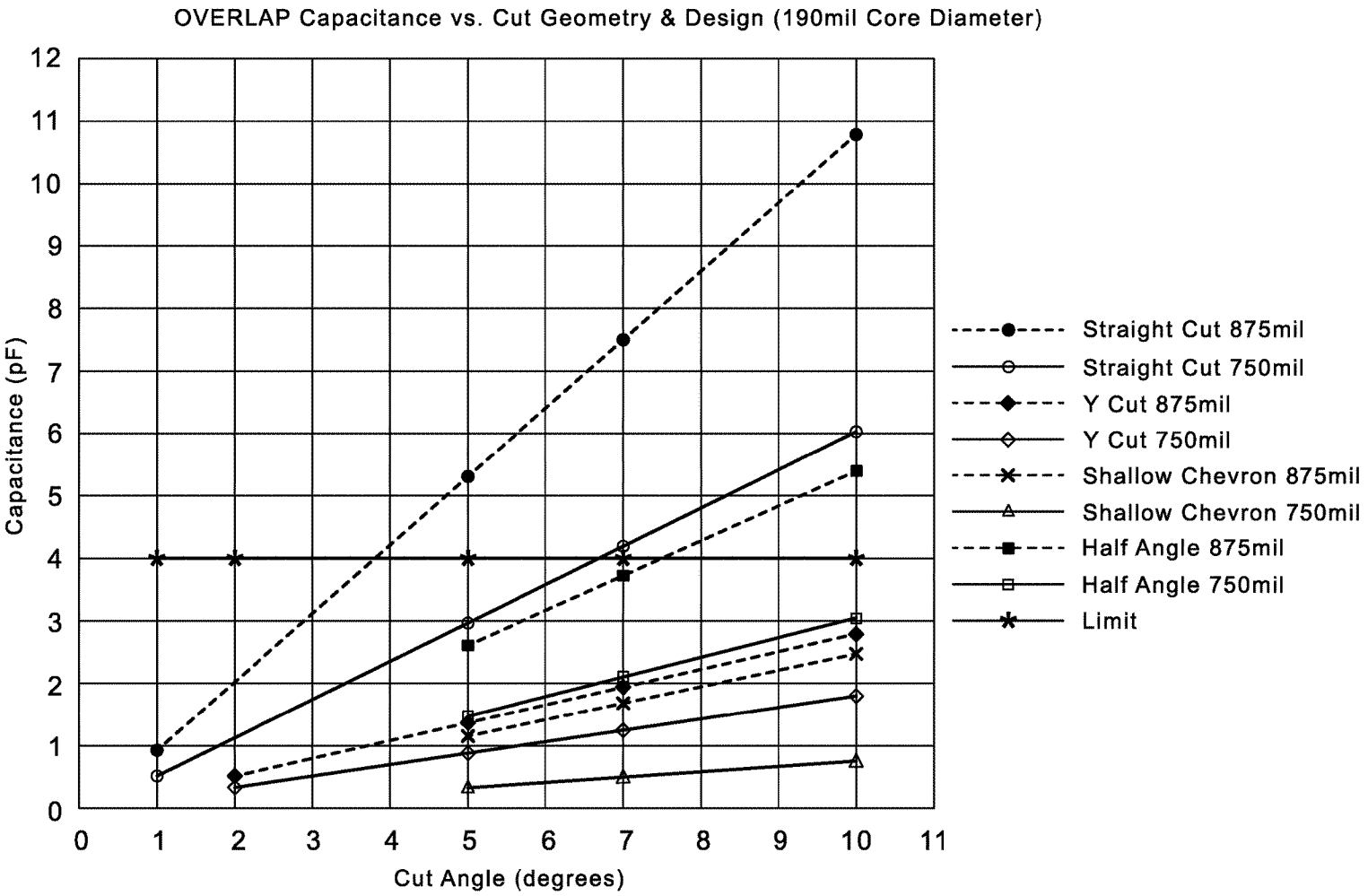

Another variable in the manufacturing process that may have a direct impact on overlap capacitance is the core size of the communications cable. For core sizes that are smaller than the nominal dimensions, the metal foil tape will wrap further around the core causing in increase in overlap capacitance. FIG. 9 shows the same sensitivity of overlap capacitance to a change in cut angle for a 190 mils cable core diameter.

In some cable designs, the metal foil tape may be applied prior to the jacketing process, (example: during the cable stranding process). In such an instance as stranding, the metal foil tape may be applied spirally around the cable. The same fundamental principles of minimizing the overlap capacitance between adjacent discontinuous segments applies in these instances; however, the optimal geometry of the cut may be different compared to a metal foil tape applied longitudinally at the jacketing process.

Note that while the present disclosure includes several embodiments, these embodiments are non-limiting (regardless of whether they have been labeled as exemplary or not), and there are alterations, permutations, and equivalents, which fall within the scope of this invention. Additionally, the described embodiments should not be interpreted as mutually exclusive, and should instead be understood as potentially combinable if such combinations are permissive. It should also be noted that there are many alternative ways of implementing the embodiments of the present disclosure. It is therefore intended that claims that may follow be interpreted as including all such alterations, permutations, and equivalents as fall within the true spirit and scope of the present disclosure.

The invention claimed is:

1. A communications cable, comprising:

a cable core comprising a plurality of twisted pairs of conductors; and a metal foil tape disposed between the cable core and a jacket of the communications cable, the metal foil tape comprising a plurality of cuts that create a plurality of discontinuous regions in a metal layer of the metal foil tape;

wherein the metal foil tape is wrapped around the cable core such that the discontinuous regions overlap to form a plurality of overlapping regions, the overlapping regions producing capacitances connected in series, thereby reducing an overall capacitance between the overlapping discontinuous regions and further wherein the plurality of cuts form a Y-shape cut having a first straight cut starting at one side of the metal foil tape and two cuts branching off of the first straight cut at opposite angles near a second side of the metal foil tape.

2. The communications cable of claim 1, wherein the overall capacitance between the overlapping discontinuous regions is reduced by a factor of two.

3. The communications cable of claim 1, wherein the plurality of overlapping regions are triangular overlapping regions.

4. The communications cable of claim 1, wherein the two cuts branching off of the first straight cut have respective angles of 4-degrees and −4-degrees.

* * * * *